US009278792B2

(12) United States Patent
Linssen

(10) Patent No.: US 9,278,792 B2
(45) Date of Patent: Mar. 8, 2016

(54) PACKAGE FOR PRODUCTS PACKED IN BLISTER PACKS, A TRAY-SHAPED SLIDE SUITABLE FOR SUCH A PACKAGE, A BLISTER PACK SUITABLE FOR SUCH A PACKAGE AS WELL AS A HOUSING SUITABLE FOR SUCH A PACKAGE

(71) Applicant: ECOBLISS HOLDING B.V., Echt (NL)

(72) Inventor: Ronaldus Josephus Marie Linssen, Echt (NL)

(73) Assignee: ECOBLISS HOLDING B.V., Echt (NL)

( * ) Notice: Subject to any disclaimer, the term of this patent is extended or adjusted under 35 U.S.C. 154(b) by 0 days.

(21) Appl. No.: 14/449,127

(22) Filed: Jul. 31, 2014

(65) Prior Publication Data

US 2016/0031622 A1 Feb. 4, 2016

(51) Int. Cl.

| | |
|---|---|
| ***B65D 75/36*** | (2006.01) |
| ***B65D 77/04*** | (2006.01) |
| ***B65D 77/26*** | (2006.01) |
| ***B65D 65/38*** | (2006.01) |

(52) U.S. Cl.

CPC ..... *B65D 77/0446* (2013.01); *B65D 65/38* (2013.01); *B65D 75/36* (2013.01); *B65D 77/26* (2013.01)

(58) Field of Classification Search

CPC ..... B65D 65/38; B65D 75/36; B65D 75/327; B65D 77/0446; B65D 77/26; B65D 83/04; B65D 83/0463; B65D 2215/04

USPC ..... 206/531, 532, 535, 536, 538, 539

See application file for complete search history.

(56) References Cited

U.S. PATENT DOCUMENTS

| | | | | |
|---|---|---|---|---|
| 5,788,079 | A * | 8/1998 | Bouthiette | 206/534 |
| 7,188,729 | B2 * | 3/2007 | DeJonge | 206/535 |
| 7,661,534 | B2 * | 2/2010 | Saclier et al. | 206/535 |
| 7,854,325 | B2 | 12/2010 | Bentele | |
| 8,220,636 | B2 * | 7/2012 | Beecroft et al. | 206/535 |
| 8,991,606 | B2 * | 3/2015 | Ortenzi | B65D 83/0463 206/531 |
| 9,174,780 | B2 * | 11/2015 | Gelardi | B65D 83/0463 |
| 2006/0157375 | A1 * | 7/2006 | DeJonge | 206/535 |

(Continued)

FOREIGN PATENT DOCUMENTS

| | | |
|---|---|---|
| EP | 0053593 A1 | 6/1982 |
| EP | 0882457 A2 | 12/1998 |

(Continued)

OTHER PUBLICATIONS

PCT Search Report from PCT/EP2014/063956 with Written Opinion dated Sep. 24, 2014.

EPO Extended Search Report from corresponding European Patent Application No. 15175627.7 mailed on Nov. 18, 2015.

*Primary Examiner* — Bryon Gehman

(74) *Attorney, Agent, or Firm* — Ladas & Parry, LLP

(57) ABSTRACT

A package for products packed in blister packs comprises a housing, a tray-shaped slide which is slidably accommodated in the housing in a sliding direction as well as a number of blister packs stacked inside the tray-shaped slide. The tray-shaped slide comprises a bottom wall and side walls connected to the bottom wall. The tray-shaped slide is provided with a pen, while each blister pack is provided with an passage, wherein the pen of the tray-shaped slide extends through the passages of all blister packs stacked inside the tray-shaped slide.

15 Claims, 5 Drawing Sheets

(56) References Cited

U.S. PATENT DOCUMENTS

| | | | | |
|---|---|---|---|---|
| 2007/0261984 | A1* | 11/2007 | Gelardi | 206/531 |
| 2009/0255842 | A1* | 10/2009 | Brozell et al. | 206/531 |
| 2010/0252478 | A1 | 10/2010 | Beecroft | |
| 2011/0108451 | A1 | 5/2011 | Sack | |
| 2011/0127320 | A1 | 6/2011 | Sams | |
| 2011/0226765 | A1 | 9/2011 | Gelardi | |
| 2012/0012497 | A1 | 1/2012 | Weston | |
| 2012/0234701 | A1 | 9/2012 | Albrecht | |

FOREIGN PATENT DOCUMENTS

| | | | |
|---|---|---|---|
| JP | S56 125816 | U | 9/1981 |
| JP | H09-058748 | A | 3/1997 |
| JP | 2011-121625 | A | 6/2011 |
| WO | 2005/068304 | A2 | 7/2005 |
| WO | 2008/061026 | A2 | 5/2008 |
| WO | 2013/070506 | A1 | 5/2013 |
| WO | 2013/151806 | A1 | 10/2013 |
| WO | 2015/000896 | | 1/2015 |

* cited by examiner

PACKAGE FOR PRODUCTS PACKED IN BLISTER PACKS, A TRAY-SHAPED SLIDE SUITABLE FOR SUCH A PACKAGE, A BLISTER PACK SUITABLE FOR SUCH A PACKAGE AS WELL AS A HOUSING SUITABLE FOR SUCH A PACKAGE

FIELD OF THE INVENTION

The invention relates to a package for products packed in blister packs, which package comprises a housing, a tray-shaped slide which is slidably accommodated in the housing in a sliding direction as well as at least one blister pack stacked inside the tray-shaped slide, which tray-shaped slide comprises a bottom wall and side walls connected to the bottom wall.

The invention also relates to a tray-shaped slide suitable for such a package, a blister pack suitable for such a package as well as a housing suitable for such a package.

BACKGROUND OF THE INVENTION

U.S. Pat. No. 7,854,325B2 discloses such kind of packages being suitable for medication blister packs. The package comprises a package housing and a drawer being slidable with respect to the package housing. The blister packs can be laid loosely in the drawer. This has the disadvantage that the blister pack can be removed from the drawer, even if the drawer is only slightly slid out of the package housing, whereby there is a risk that small children can obtain access to the blister packs and its content.

By another embodiment a folded blister pack is connected by a film hinge to the drawer. The blister pack is thus connected directly to the drawer and offers the possibility of being unfolded to allow removal of the medications. By yet another embodiment the blister pack is welded at a point to the drawer. By yet a further embodiment the blister pack has at one end an insertion tab, which can be inserted into a corresponding opening formed in an edge of the drawer. In case that the blister pack is connected directly to the drawer, a medication blister pack, for example, cannot be removed from the drawer and therefore cannot be lost.

However, a disadvantage of this known package is that the blister packs need to be connected to each other or to the tray-shaped slide, which requires additional process steps. Furthermore, connecting the blister pack to the tray-shaped slide is only possible for one single blister pack and nearly impossible for a number of blister packs.

SUMMARY OF THE INVENTION

The object of the invention is to provide a package whereby at least one but also a number of blister packs can be easily be locked inside the tray-shaped slide.

This object is accomplished with the package according to the invention in that the tray-shaped slide is provided with a pen, whilst said at least one blister pack is provided with an passage, wherein the pen of the tray-shaped slide extends through the passage of said at least one blister pack stacked inside the tray-shaped slide.

As long as the tray-shaped slide is located inside the housing, the pen extending through the passage of the blister pack prevents that a blister pack can be pulled on and slide out of the housing.

The package may contain one blister pack or a number of blister packs stacked onto each other, whereby the pen extends through the passages of all the blister packs.

An embodiment of the package according to the invention is characterized in that the pen extends substantially perpendicular to the bottom wall of the tray-shaped slide.

Such a pen can easily be formed on the bottom wall, whereby the lowest blister pack of the stacked blister packs can be located against the bottom wall so that a large number of blister packs can be stacked inside the tray-shaped slide Another embodiment of the package according to the invention is characterized in that the pen has a conical shape.

Due to such conical shape, the passage of a blister pack can easily be placed around the pen, whilst near the side of the pen connected to the bottom wall or other wall of the tray-shaped slide, the pen can nearly fill the passage so that the blister pack is being prevented from movement with respect to the pen in a plane extending perpendicular to a main axis of the pen.

Furthermore, if the tray-shaped slide is being made by thermoforming such conical shape of the pen simplifies the removal of the tray-shaped slide from the moulds used by thermoforming.

Another embodiment of the package according to the invention is characterized in that one side wall of the tray-shaped slide extending perpendicular to the sliding direction is provided with a pivotable flap, which flap extends over the pen.

Such flap prevents the blister pack from being lift off the pen, when the tray-shaped slide is located inside the housing.

Another embodiment of the package according to the invention is characterized in that the flap is provided with two projections located on opposite sides of the pen.

Such projections, which are directed towards the blister pack, prevent the blister pack even more from being lift off the pen, when the tray-shaped slide is located inside the housing.

Another embodiment of the package according to the invention is characterized in that the housing comprises a top wall, which top wall is provided with a pivotable part on a side extending perpendicular to the sliding direction, whereby in a position in which the tray-shaped slide is partly slid out of the housing in the sliding direction, the flap of the tray-shaped slide is located between the top wall and the pivotable part of the top wall of the housing, preventing the tray-shaped slide to slide fully out of the housing.

The pivotable part extends substantially parallel to said top wall, leaving enough space between the pivotable part and the top wall so that the flap of the tray-shaped slide will be caught between them. Due to such pivotable part in combination with the flap, the tray-shaped slide and the housing are connected to each other. Since also the blister pack is or all blister packs are prevented from being removed from the tray-shaped slide by means of the pen located inside the passages of the blister packs, all elements of the package are connected to each other and form an immediate, or primary package as defined in the US PPPA (Poison Prevention Packaging Act).

Another embodiment of the package according to the invention is characterized in that seen in the sliding direction, the pivotable part of the top wall of the housing is located at a front side of the housing, whilst the flap of the tray-shaped slide is located at a rear side of the tray-shaped slide.

Only the front side of the package can be opened to allow the tray-shaped slide to be slid partly out of the housing. The rear side of the package is closed to prevent the tray-shaped slide to be slid out through the rear side.

Since the flap is located on the other side of the package than the pivotable part, the tray-shaped slide can be slid out of the housing over a relatively large distance before the flap of the trays-shaped slide is located between the top wall and the pivotable part of the top wall of the housing and the tray-shaped slide is being prevented to slide fully out of the housing.

Another embodiment of the package according to the invention is characterized in that the bottom wall of the tray-shaped slide is provided with a hole.

A user can put his finger in the hole to push the blister pack(s) upwards to simplify the removal of a blister pack from the tray-shaped slide.

Another embodiment of the package according to the invention is characterized in that the tray-shaped slide comprises at least one flange-shaped upper edge spaced from the bottom wall, which at least one flange-shaped upper edge is connected to the side walls, which flange-shaped upper edge comprises two parts that extend parallel to the sliding direction, wherein each part is provided with at least one hook-shaped element, whilst the housing comprises two side walls, wherein each side wall is provided with at least one recess, wherein a recess and a hook-shaped element located at a first side wall are staggered, seen in the sliding direction, relative to a recess and a hook-shaped element located at a second side wall, wherein the hook-shaped elements of the flange-shaped upper edge can be moved out of the recesses against the spring force of the flange-shaped upper edge.

Because the part of the flange-shaped upper edge that extends parallel to the sliding direction is provided with the hook-shaped element and can also be moved out of the recess against the spring force of the flange-shaped upper edge, separate projections and spring elements are not needed. As a result, the tray-shaped slide is relatively easy to produce. The hook-shaped element can be moved into engagement with the recess located in the side wall of the housing under the spring force of the flange-shaped upper edge. Said recess can be formed in the housing in a simple manner, for example by punching. Once the hook-shaped element has been moved out of the recess against spring force, the tray-shaped slide can be moved in the sliding direction, with the hook-shaped element simply sliding along the inner side of the housing.

When the tray-shaped slide is pulled at, without the hook-shaped elements being pressed out of the recesses, the hook-shaped elements will prevent the tray-shaped slide from being moved out of the housing.

The provision of a hook-shaped element that can be positioned in a recess on either side of the package makes it difficult for a child to open the package, because both hook-shaped elements must be removed from the respective recesses simultaneously before the tray-shaped slide can be moved in the sliding direction.

Moreover, because the hook-shaped elements are staggered, it will be virtually impossible for a young child of about 4 years old to place its fingers so that both staggered hook-shaped elements are removed simultaneously, against spring force, from the likewise staggered recesses.

According to European and US legislation, a package may be called childproof if it meets the EN/ISO8317 standard and/or the US 16 CRF 1700.20 standard, respectively. Both standards prescribe extensive testing both with seniors (50-70 years old) and with children aged about 4 years. The tests are carried out by certified (ISO 17025) test agencies. It has been found that the package according to the invention is able to meet the prevailing standards.

Another embodiment of the package according to the invention is characterized in that the tray-shaped slide is made of plastic material, using a thermoforming process.

With a thermoforming process, the tray-shaped slide can easily be made, whereby the pen can be formed integrally with the bottom wall.

BRIEF DESCRIPTION OF THE DRAWINGS

The package according to the invention will further be explained with reference to the drawings, wherein.

In the drawings, like reference numerals refer to like elements.

DESCRIPTION OF THE FIGURES

Figure 1A:
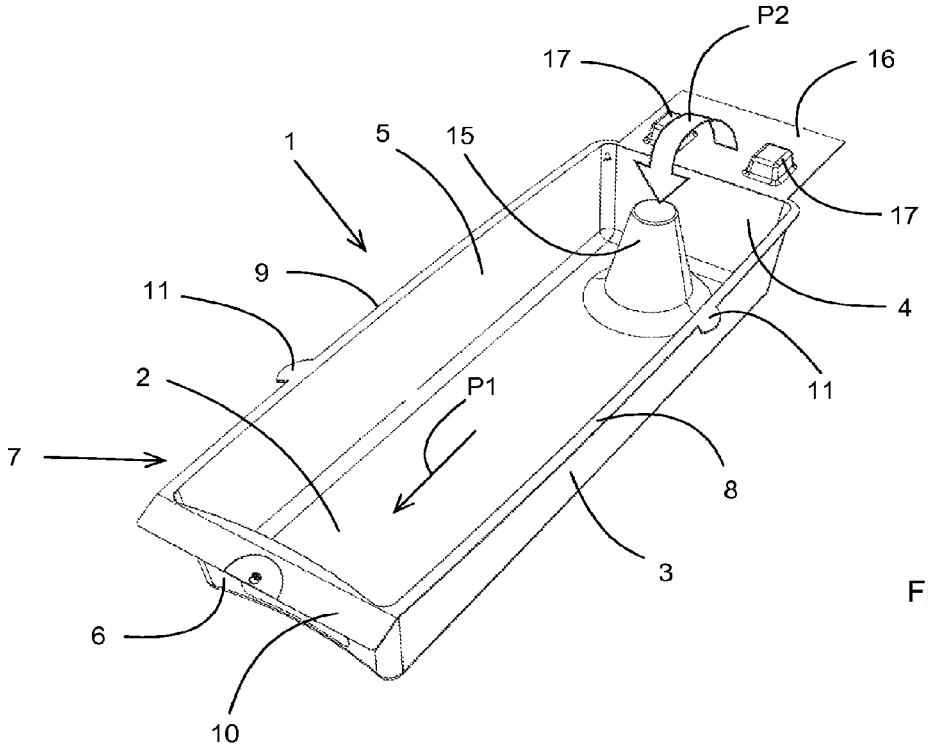
FIGS. 1A and 1B show perspective views of a tray-shaped slide according to the invention.
Figure 1B:
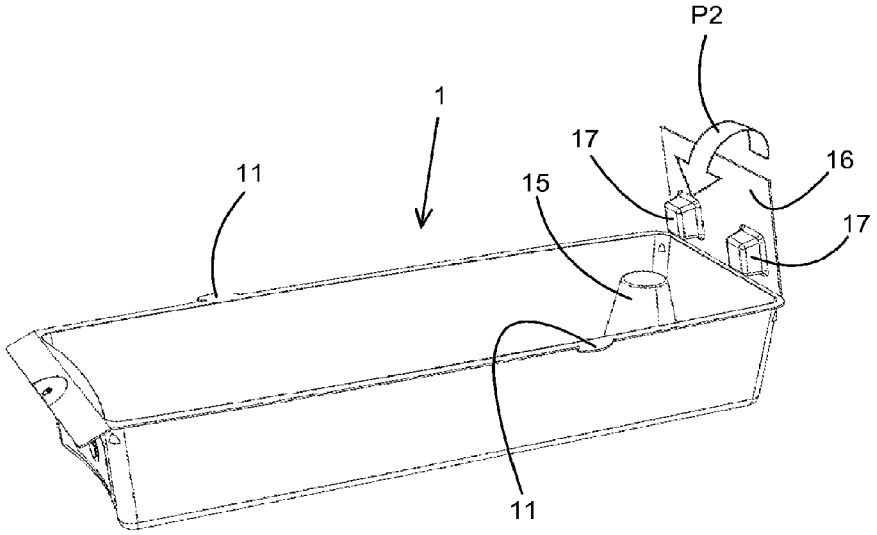

FIGS. 1A and 1B show perspective views of a tray-shaped slide 1 according to the invention. The slide 1 comprises a bottom wall 2 and side walls 3, 4, 5, 6 extending along the circumference of the bottom wall 2. Each side walls 3, 4, 5, 6 include an angle slightly greater than 90 degrees with the bottom wall 2. The slide 1 further comprises a flange-shaped, endless upper edge 7, spaced from the bottom wall 2, which is connected to the side walls 3, 4, 5, 6. The upper edge 7 comprises two parts 8, 9 extending parallel to the sliding direction indicated by the arrow P1, as well as a part 10 extending transversely to the sliding direction indicated by the arrow P1. The part 10 is located at a front side of the tray-shaped slide 1, seen in the sliding direction indicated by the arrow P1. The parts 8, 9 each comprise a hook-shaped element 11, spaced from the part 10. The hook-shaped elements are staggered in the sliding direction indicated by the arrow P1, similarly to recesses 12, 13 of the housing 14 (see FIGS. 6A-6E). In a direction transversely to the bottom wall 2, the hook-shaped element 11 has the same thickness as the upper edge 7. The tray-shaped slide 1 as described so far is also described in the international patent application PCT/EP2014/063956 of applicant which is incorporated by reference.

The tray-shaped slide 1 according to the invention is provided with a conical pen 15 located near a rear side of the tray-shaped slide 1 and formed integrally with the bottom wall 2 during thermoforming of the tray-shaped slide 1. The pen 15 is hollow. The pen 15 extends substantially perpendicular to the bottom wall 2 of the tray-shaped slide 1. The side wall 4 located near the conical pen 15 is provided with a pivotable flap 16. The side wall 4 extends perpendicular to the sliding direction. The flap 16 is provided with two projections 17 located on opposite sides of the pen 15.

Figure 2:
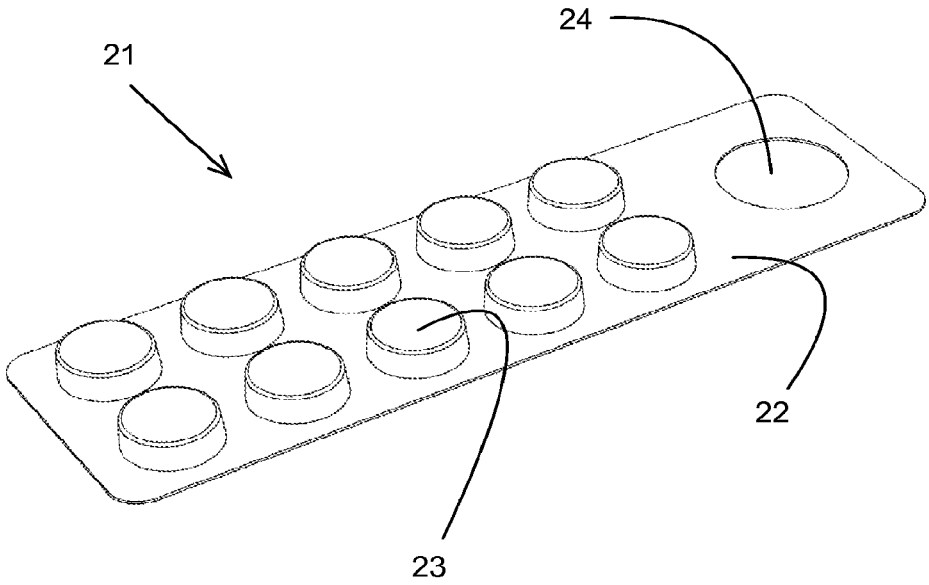
FIG. 2 shows a perspective view of a blister pack according to the invention.

FIG. 2 shows a perspective view of a blister pack 21 according to the invention, the blister pack 21 comprises a base plate 22 with a number of closed pockets 23 each comprising a product, for example medical pills. The blister pack 21 comprises a passage 24 extending through the base plate 22. The passage 22 has a diameter being slightly larger than the diameter of the pen 15 at a position near the bottom wall 2.

Figure 3:
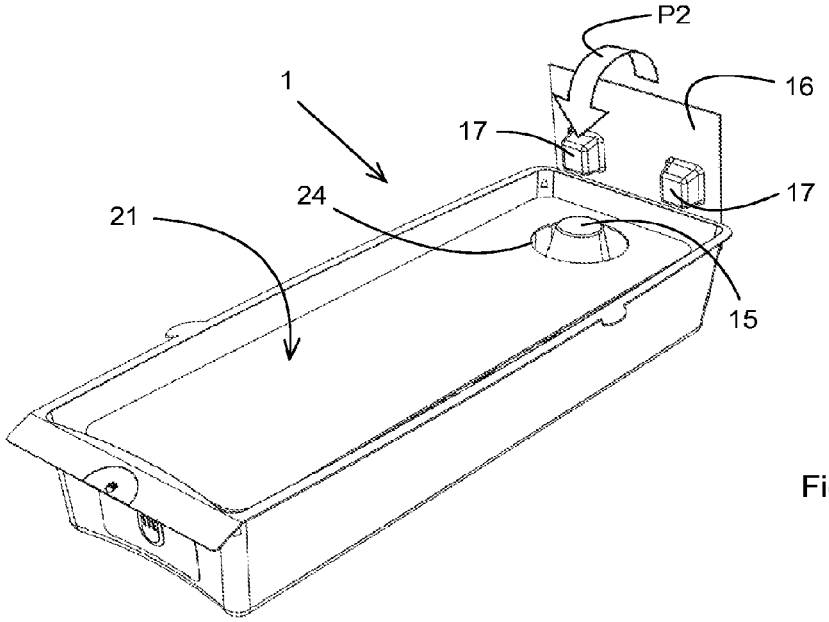
FIG. 3 shows a perspective view of the tray-shaped slide as shown in FIG. 1 with a stack of blister packs as shown in FIG. 2, with a flap in an intermediate position.
Figure 4:
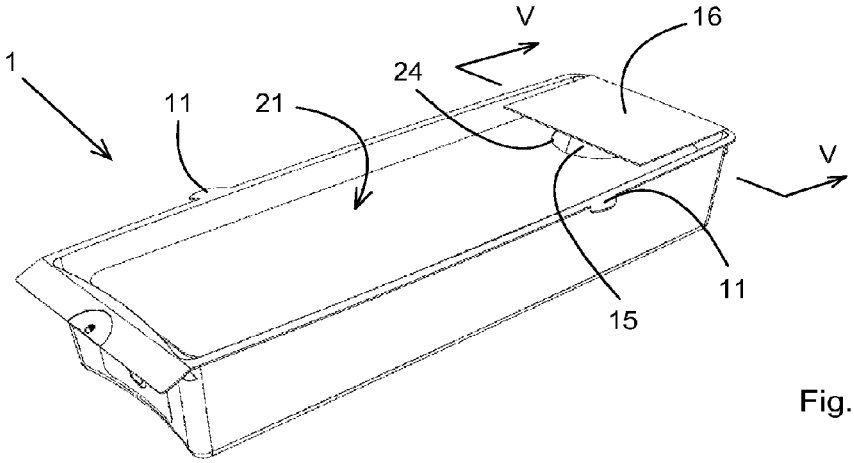
FIG. 4 shows a perspective view of the tray-shaped slide as shown in FIG. 1 with a stack of blister packs as shown in FIG. 2, with a flap in a use position, FIG. 5 show a cross section of the tray-shaped slide as shown in FIG. 4, in the direction indicated by arrows V-V.

FIG. 3 shows the tray-shaped slide 1 into which a number of blister packs 21 are being stacked, whereby the pen 15 extends through the passages 24. After all blister packs 21 are being stacked inside the tray-shaped slide 1, the flap 16 is being pivoted towards the blister packs 21 in the direction as indicated by arrow P2 until the projections 17 are located near the upper blister pack 21, as shown in FIG. 4. Due to the spring force of the material of the tray-shaped slide 1, the flap 15 intends to move slightly back in a direction opposite to the direction indicated by arrow P2.

Figure 5:
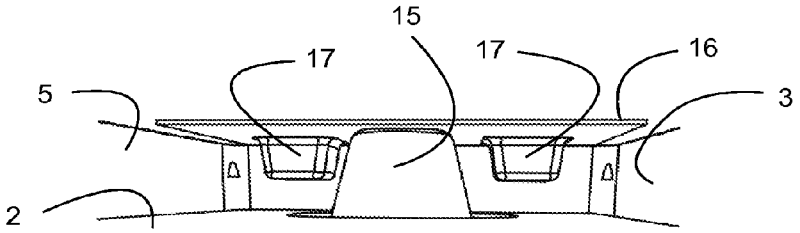

FIG. 5 shows a cross section of the tray-shaped slide 1 as shown in FIG. 4, wherein the two projections 17 are located next to the pen 15 on opposite sides thereof.

FIGS. 6A-6E show different perspective views of inserting the tray-shaped slide 1 inside the 14 housing of a package 33 according to the invention.

The housing 14 can be made of cardboard. The housing 14 comprises a bottom side 19, two side walls 20 extending transversely to the bottom side 19, a rear wall 18 extending transversely to the bottom side 19 and the side walls 20, an top wall 26 extending parallel to the bottom side 19, and a first flap 36 which is pivotally connected about a pivot line 37 to the bottom side 19. The flap 36 is provided with a flap portion 25 which is pivotable about a pivot line 37, which flap portion 25 can be positioned near the top wall 26 on an inner side thereof. Such a rectangular housing 14 is known per se and will not be discussed in more detail herein, therefore. On a side remote from the rear wall 18, the top wall 26 of the housing 14 is provided with an opening 27.

The housing 14 is provided with a pair of recesses 12, 13, which extend through the side of the side walls 20 that faces the top wall 26 and the sides of the top wall 26 that face the side walls 20. The part of the recesses 12, 13 that is provided in the side walls 20 is rectangular in shape. The part of the recesses 12, 13 that is provided in the top wall 26 is arcuate in shape. The recesses 12, 13 are staggered with respect to each other in the same manner as the hook-shaped elements 11 of the tray-shaped slide 1. The housing 14 provided with recess 12, 13 forms part of the package as described in the international patent application PCT/EP2014/063956 of applicant which is incorporated by reference.

The housing 14 according to the invention comprises a second flap 38 pivotable connected about a pivot line 29 to the top wall 26. The housing 14 also comprises a third and fourth flap 30, 31 pivotable connected to the sidewalls 20. Between the four flaps 23, 28, 30, 31 the housing 14 comprises an entrance opening 32 for inserting the tray-shaped slide 1. The second pivotable flap 28 forms the pivotable part of the housing 14.

The rear wall 18 is firmly connected to the bottom side 19, the side walls 20, and the top wall 26, due to which the housing 14 is closed at the rear side.

Seen in the sliding direction, the pivotable flap 28 of the top wall 26 of the housing 14 is located at a front side of the housing 14, whilst the flap 16 of the tray-shaped slide 1 is located at a rear side of the tray-shaped slide 1.

Figures 6A, 6B, 6C, 6D, 6E:
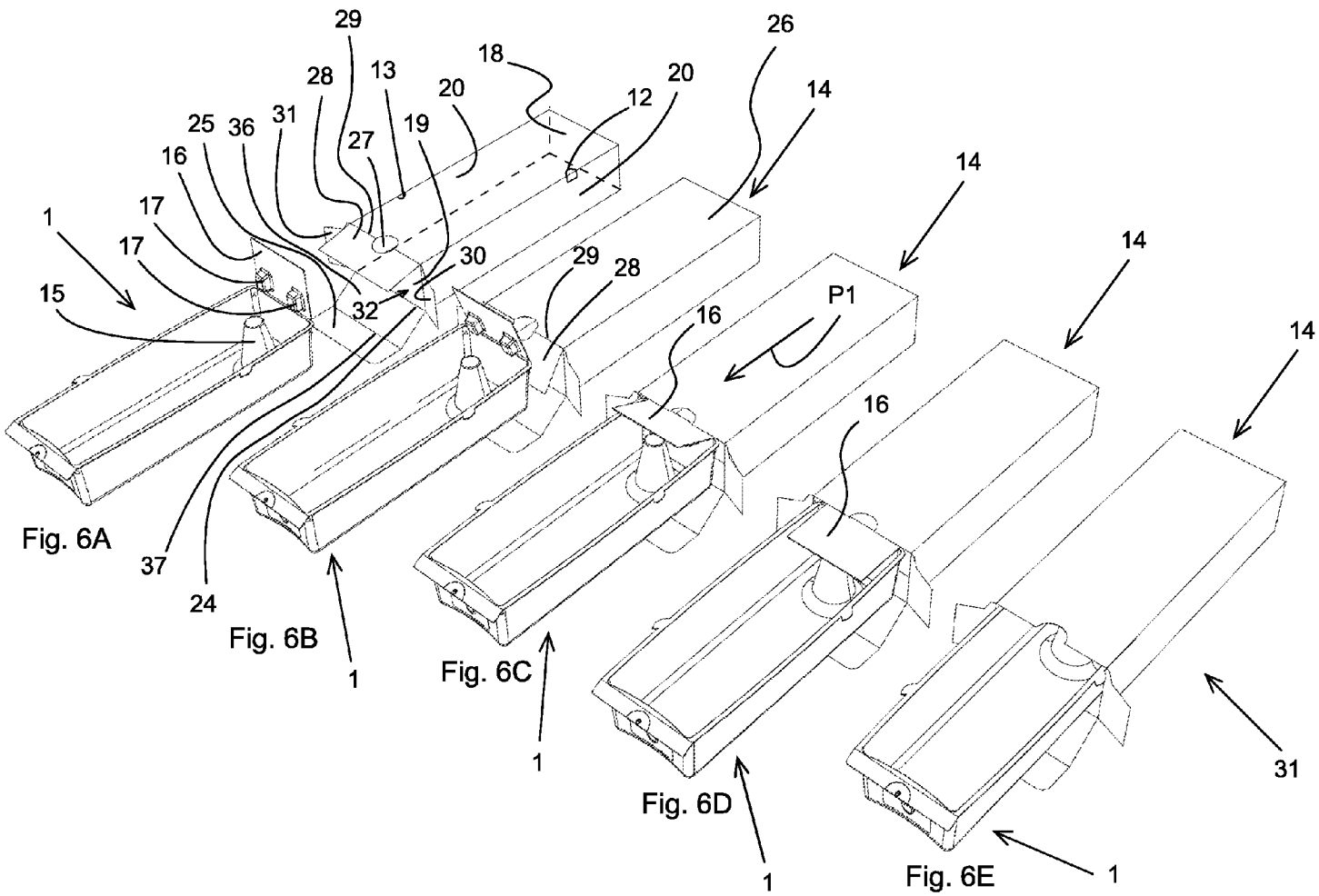
FIGS. 6A-6E show different perspective views of inserting the tray-shaped slide as shown in FIG. 1 inside a housing of a package according to the invention.

FIG. 6A shows the tray-shaped slide 1 and the housing 14 before inserting the tray-shaped slide 1 into the housing 14.

In FIG. 6B it can be seen that the second flap 28 is being pivoted about the pivot line 29 through the opening 32 into the housing 14 to be positioned almost parallel to and near the top wall 26. Due to the spring force of the material of the housing 14, the second flap 28 intends to move slightly downwards leaving open a space between the top wall 26 and the second flap 28.

In the FIGS. 6A-6E no blister packs 21 are located inside the tray-shaped slide 1 but it is clear that such blister packs 21 can be located inside the tray-shaped slide 1 as shown in FIGS. 3 and 4.

By moving the tray-shaped slide 1 in a direction opposite to the sliding direction indicated by 5 the arrow P1 into the housing 14, the flap 16 of the tray-shaped slide 1 will be forced to pivot into the direction indicated by the arrow P2 so that the tray-shaped slide 1 can be slid inside the housing 14 (FIGS. 6C, 6D and 6E). As the tray-shaped slide 1 is located completely inside the housing 14, the third and fourth flaps 30, 31 are pivoted towards the opening 32 after which the flap 25 is positioned inside the housing 14 against the second flap 28, whereby the flap 23 closes the opening 32.

The package 33 according to the invention comprises the tray-shaped slide 1 a single or a number of stacked blister packs 21 and a housing 14.

When a user wants to remove a blister pack 21 from the package 33, he opens the flaps 23, 25, 30 and 31. Subsequently he simultaneously puts two fingers of one hand on the staggered hook-shaped elements 11 to push them through the recesses 12, 13. With his other hand he pulls on the part 10 to pull the tray-shaped slide 1 in the sliding direction as indicated by arrow P1. Such movement can not be done by small children so that the package 33 is child-proof.

Figure 7:
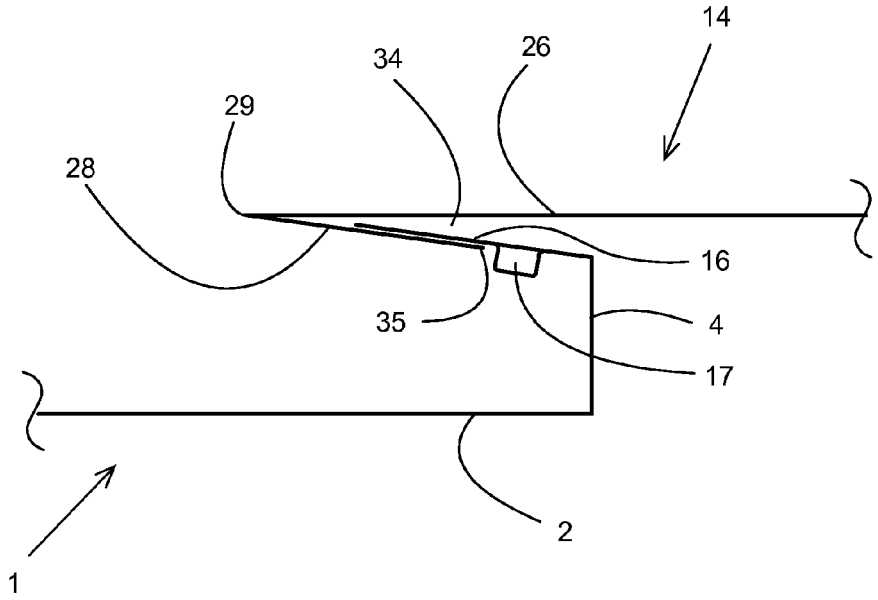
FIG. 7 shows a schematic cross section of the package according to the invention in a position wherein the tray-shaped slide is slid out of the housing as far as possible.

The user pulls the tray-shaped slide 1 in the sliding direction as indicated by arrow P1 until the flap 16 of the tray-shaped slide 1 is located inside the space 34 between the top wall 26 and the second flap 28 of the housing 14 and an edge 35 of the flap 28 rests against the projections 17. See FIG. 7 showing a schematic view thereof. Due to the interaction between the flaps 16, 28 the tray-shaped slide 1 is prevented to slide fully out of the housing 14.

Since the pen 15 of tray-shaped slide 1 extends through the passage 24 of each blister pack 21 and the projections 17 of the flap 16 are located on both sides of the pen 15, the complete blister pack 21 can not be removed from the tray-shaped slide 1 once it is located inside the housing 14.

However, a user does have access to the blister packs 21 once the tray-shaped slide 1 has been partly slid out of the housing 14 and can remove a product from a pocket 23.

It is possible to provide the bottom wall of the tray-shaped slide 1 with a hole through which a user can put his finger to push the blister packs upwards.

It is also possible to perforate the blister pack between the individual pockets 23 to allow the removal of a single product or to allow the removal of an empty blister pack 21.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and
the appended claims.

In the claims, the word "comprising" does not exclude other elements or steps, and the indefinite article "a" or an does not exclude a plurality. The mere fact that certain measures are recited in mutually different dependent claims does not indicate that a combination of these measures cannot be used to advantage. Any reference signs in the scope should not be construed as limiting the scope of the claims.

The invention claimed is:

1. A package for products packed in blister packs, which package comprises:

a housing comprising a housing bottom side, housing side walls extending transversely to the housing bottom side and a housing top wall;

a tray-shaped slide comprising a tray bottom wall, tray side walls connected to the tray bottom wall, and a pen, the tray-shaped slide being slidably located in the housing in a sliding direction extending parallel to the housing bottom side, the housing side walls and the housing top wall;

at least one blister pack stacked inside the tray-shaped slide, said at least one blister pack including a passage, wherein the pen of the tray-shaped slide extends through the passage of said at least one blister pack stacked inside the tray-shaped slide, wherein one of the tray side walls extending perpendicular to the sliding direction includes a pivotable flap, which flap extends over the pen, wherein the housing top wall includes a pivotable part on a side extending perpendicular to the sliding direction, the pivotable part is configured such that when the tray-shaped slide is partly slid out of the housing in the sliding direction, the flap of the tray-shaped slide is located between the housing top wall and the pivotable part of the top wall of the housing, preventing the tray-shaped slide to slide fully out of the housing.

2. A package according to claim 1, wherein the pen extends substantially perpendicular to the tray bottom wall.

3. A package according to claim 1, wherein the pen has a conical shape.

4. A package according to claim 1, wherein the pivotable flap is provided with two projections located on opposite sides of the pen.

5. A package according to claim 1, wherein seen in the sliding direction, the pivotable part of the housing top wall is located at a front side of the housing, and the pivotable flap of the tray-shaped slide is located at a rear side of the tray-shaped slide.

6. A package according to claim 1, wherein the tray bottom wall is provided with a hole.

7. A package according to claim 1, wherein the tray-shaped slide further comprises:

at least one flange-shaped upper edge spaced from the tray bottom wall, which at least one flange-shaped tray upper edge is connected to the tray side walls, which the at least one flange-shaped upper edge comprises two parts that extend parallel to the sliding direction, wherein each part is provided with at least one hook-shaped element, and the housing further comprises:

two housing side walls, wherein each housing side wall is provided with at least one recess, wherein the at least one recess and the at least one hook-shaped element located at a first tray side wall are staggered, seen in the sliding direction, relative to the at least one recess and the at least one hook-shaped element located at a second tray side wall, wherein the at least one hook-shaped elements of each part of the at least one flange-shaped upper edge can be moved out of the at least one recess of each side wall against a spring force of the at least one flange-shaped upper edge.

8. A package according to claim 1, wherein the tray-shaped slide is made of plastic material, using a thermoforming process.

9. A tray-shaped slide suitable for a package according to claim 1, the tray-shaped slide comprises:

a tray bottom wall, tray side walls connected to the tray bottom wall, and at least one flange-shaped tray upper edge, which is spaced from the tray bottom wall, is connected to the tray side walls, and comprises two parts that extend parallel to the sliding direction, wherein each part is provided with at least one hook-shaped element, where the tray bottom wall is provided with a pen, wherein one of the tray side walls of the tray-shaped slide extending perpendicular to the sliding direction is provided with a pivotable flap, which flap extends over the pen.

10. The tray-shaped slide of claim 9, wherein the pen extends substantially perpendicular to the tray bottom wall.

11. The tray-shaped slide of claim 9, wherein the pen has a conical shape.

12. The tray-shaped slide of claim 9, wherein the pivotable flap is provided with two projections located on opposite sides of the pen.

13. The tray-shaped slide of claim 9, wherein the tray bottom wall is provided with a hole.

14. A housing suitable for a package according to claim 1, which housing comprising: a housing bottom side, housing side walls extending transversely to the housing bottom side, a housing top wall, and a pivotable part attached to the housing top wall, which pivotable part configured to be pivotable to a position substantially parallel to said housing top wall within the housing.

15. The package of claim 1, wherein the pivotable part comprises a flap, wherein the flap is attached to the housing top wall at a pivot line.

* * * * *